US008079880B2

(12) United States Patent
Lin et al.

(10) Patent No.: US 8,079,880 B2
(45) Date of Patent: Dec. 20, 2011

(54) CONNECTOR ASSEMBLY FEATURED HEAD-TO-HEAD MATING INTERCONNECTION AND QUICK-DISCONNECTION THEREFROM

(75) Inventors: Wei-Chung Lin, Tu-Cheng (TW); Bin Peng, Kunshan (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 65 days.

(21) Appl. No.: 12/646,835

(22) Filed: Dec. 23, 2009

(65) Prior Publication Data

US 2010/0248521 A1 Sep. 30, 2010

(30) Foreign Application Priority Data

Mar. 31, 2009 (TW) ..... 98205034

(51) Int. Cl.
*H01R 24/04* (2006.01)

(52) U.S. Cl. ..... 439/668; 439/675; 439/700

(58) Field of Classification Search ..... 439/668, 439/669, 675, 700
See application file for complete search history.

(56) References Cited

U.S. PATENT DOCUMENTS

| | | | | | |
|---|---|---|---|---|---|
| 304,086 | A * | 8/1884 | Edison | 439/664 |
| 503,349 | A * | 8/1893 | Lee | 439/271 |
| 2,141,587 | A * | 12/1938 | Wright | 439/571 |
| 2,151,882 | A * | 3/1939 | Woodhead | 439/271 |
| 2,292,242 | A * | 8/1942 | Sagona | 439/734 |
| 2,520,739 | A * | 8/1950 | Shaw | 439/268 |
| 2,858,518 | A * | 10/1958 | Chrystie et al. | 439/426 |
| 3,281,620 | A * | 10/1966 | Miller | 313/113 |
| 4,077,690 | A * | 3/1978 | Koether | 439/320 |
| 4,550,967 | A * | 11/1985 | Riches et al. | 439/332 |
| 4,583,084 | A * | 4/1986 | Henderson et al. | 340/573.4 |
| 5,399,102 | A * | 3/1995 | Devine | 439/505 |
| 5,486,117 | A * | 1/1996 | Chang | 439/357 |
| 5,752,847 | A * | 5/1998 | McCormick | 439/349 |
| 5,823,829 | A * | 10/1998 | Suzuki | 439/668 |
| 6,149,469 | A * | 11/2000 | Kim | 439/668 |
| 6,382,999 | B1 | 5/2002 | Hai | |
| 6,439,906 | B1 * | 8/2002 | Gray et al. | 439/188 |
| 6,910,911 | B2 * | 6/2005 | Mellott et al. | 439/358 |
| 7,108,514 | B2 * | 9/2006 | Chen et al. | 439/63 |
| 7,446,672 | B2 * | 11/2008 | Johnson et al. | 340/870.02 |
| 2011/0159741 | A1 * | 6/2011 | Tung et al. | 439/660 |

FOREIGN PATENT DOCUMENTS

TW 299904 3/1997

* cited by examiner

*Primary Examiner* — Neil Abrams
(74) *Attorney, Agent, or Firm* — Andrew C. Cheng; Wei Te Chung; Ming Chieh Chang

(57) ABSTRACT

An electrical connector (100) includes an insulative housing (10) and a plurality of contacts received to the housing. The housing defines a mating face (10), a supporting face (A) facing to the mating face and a mating cavity (101) recessed from the mating face towards the supporting face and disposed therebetween. The plurality of contacts includes a central contact (4) and a first contact (2), and the central contact defines a contacting portion (42) exposed onto the supporting face and a soldering portion (43) extending out of the housing, the first contact includes at least two arc-shaped contacting arms (23) projecting into the mating cavity and disposed beside the contacting portion of the central contact. A mating connector (200) can be disconnected and dropped from the mating cavity rapidly under an abnormal force oblique and angled to a mating direction.

20 Claims, 15 Drawing Sheets

CONNECTOR ASSEMBLY FEATURED HEAD-TO-HEAD MATING INTERCONNECTION AND QUICK-DISCONNECTION THEREFROM

BACKGROUND OF THE INVENTION

1. Field of the Invention

The present invention relates to a connector assembly, and more particularly to a connector assembly in which male and female connectors are head-to-head interconnected, while can be quickly disengaged with each other by tilting a plug connector.

2. Description of the Related Art

U.S. Pat. No. 6,382,999 issued to Mou et al. on May 7, 2002 discloses an electrical connector assembly including a socket connector and a plug connector mating with the socket connector. The socket connector includes a housing defining a mating cavity opening through a mating face and a plurality of contacts retained to the housing. The plurality of contacts includes a central contact which defines a contacting post projecting into the mating cavity and further adjacent to the mating face. The plug connector includes a contact having a U-shaped contacting portion which defines two separate contacting arms with a receiving room defined therebetween. When the plug connector is inserted into the mating cavity, the contacting post enters into the receiving room deeply and is gripped by the contacting arms steadily, thereby facilitating a perfect interconnection between the socket and plug connectors.

Since the contacting post is deeply inserted into the receiving room, the disengagement therefrom can only be done when the contacting post is in aligning with the socket. If the force used to pull the plug out of the socket is not perfect align with the insertion direction of the plug, i.e. the pulling force is kind of normal to the plug, then the plug connector will be difficult to be remove therefrom. Therefore, a new design is required.

SUMMARY OF THE INVENTION

An object of the present invention is to provide an electrical connector from which a mating connector can be disconnected and dropped rapidly even in a direction oblique to a mating direction.

In order to achieve the above-mentioned object, an electrical connector includes an insulative housing and a plurality of contacts received to the housing. The housing defines a mating face, a supporting face facing to the mating face and a mating cavity recessed from the mating face towards the supporting face and disposed therebetween. The plurality of contacts includes a central contact and a first contact, and the central contact defines a contacting portion exposed onto the supporting face and a soldering portion extending out of the housing, the first contact includes at least two arc-shaped contacting arms projecting into the mating cavity and disposed beside the contacting portion of the central contact.

Other objects, advantages and novel features of the invention will become more apparent from the following detailed description of the present embodiment when taken in conjunction with the accompanying drawings.

DETAILED DESCRIPTION OF THE INVENTION

Figure 1:
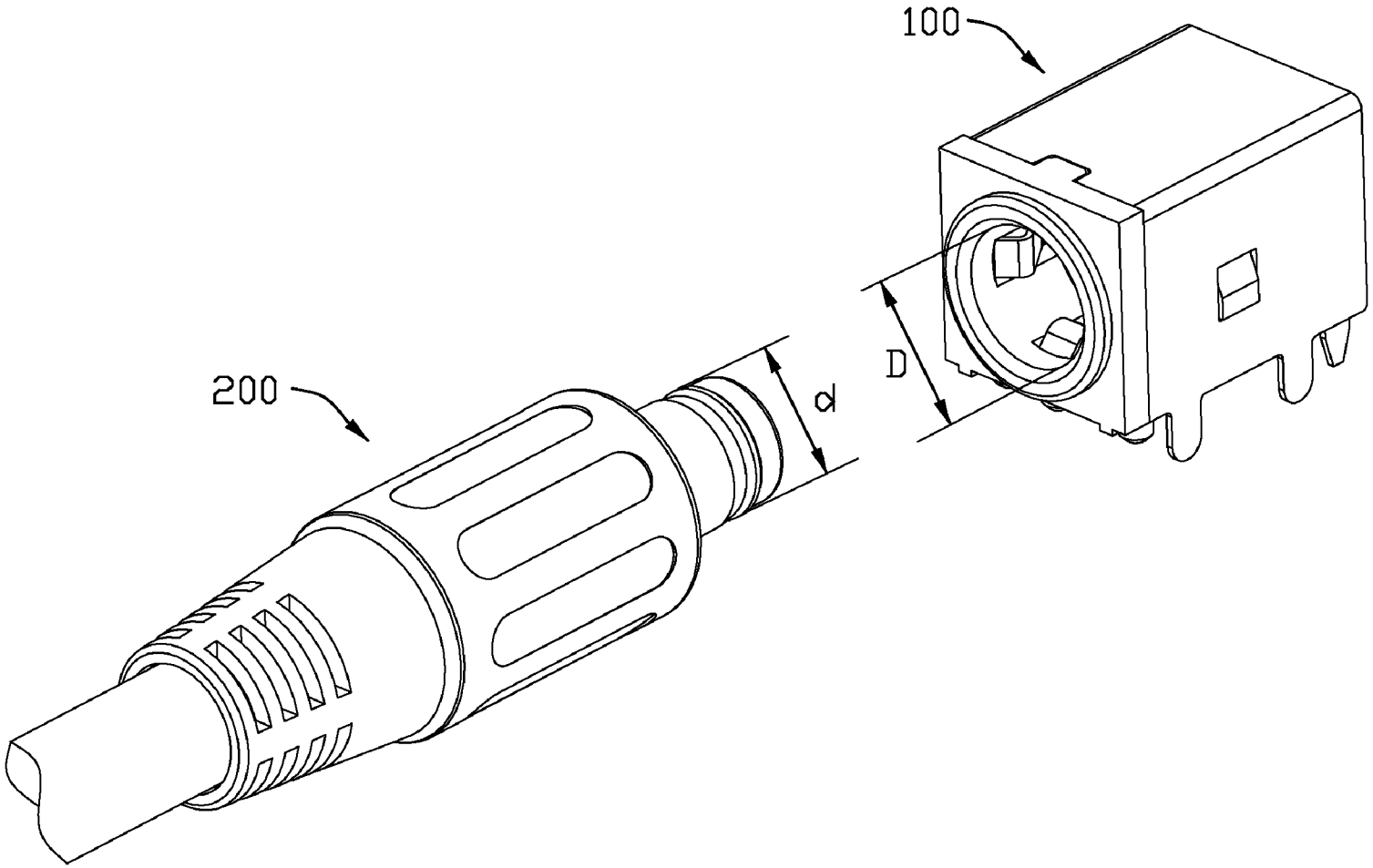
FIG. 1 is a perspective view of an electrical connector assembly in accordance with a first embodiment of the present invention.

Reference will now be made to the drawing figures to describe the preferred embodiment of the present invention in detail.

Referring to FIG. 1 to FIG. 8, an electrical connector assembly made in accordance with the present invention is provided. The electrical connector assembly includes a first (or socket) connector 100 and a second (or plug) connector 200 mating with the first connector. The first connector includes an insulative housing 1, a central contact 4 and a first contact 2 retained to the housing and a shell 5 surrounding the housing 1.

Figure 4:
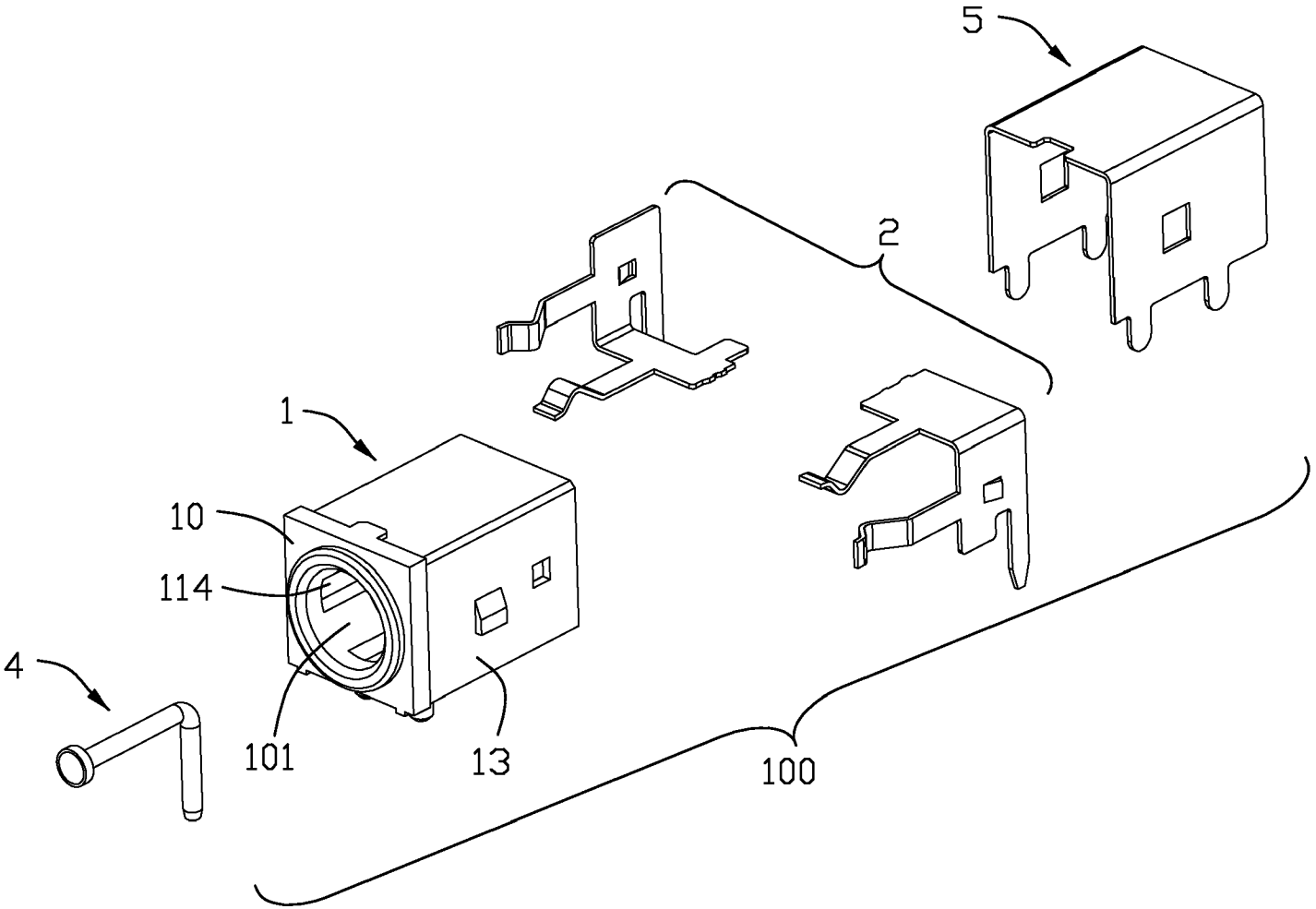
FIG. 4 is an exploded perspective view of the first connector shown in FIG. 1.
Figure 5:
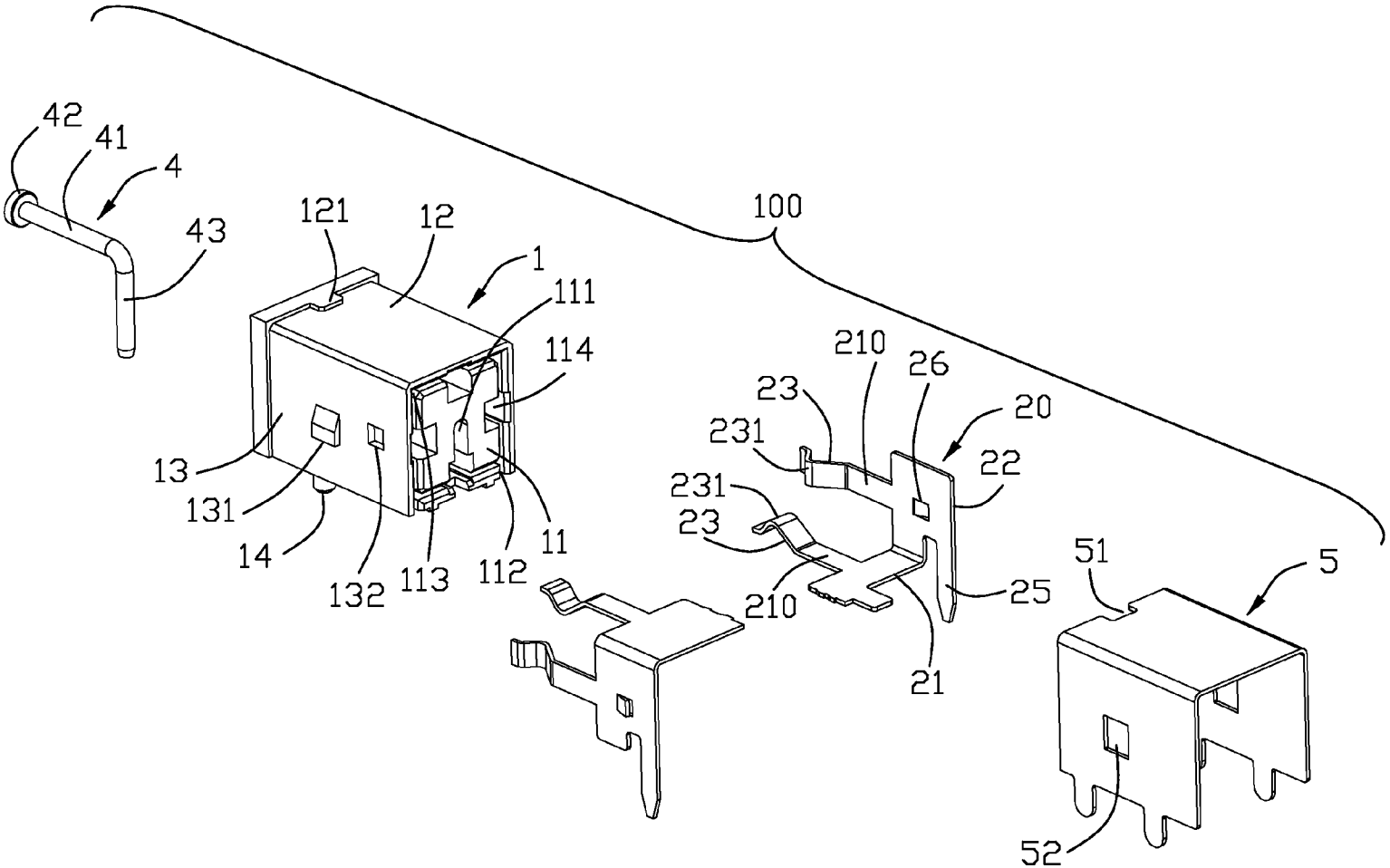
FIG. 5 is another perspective view of the first connector shown in FIG. 4.
Figure 6:
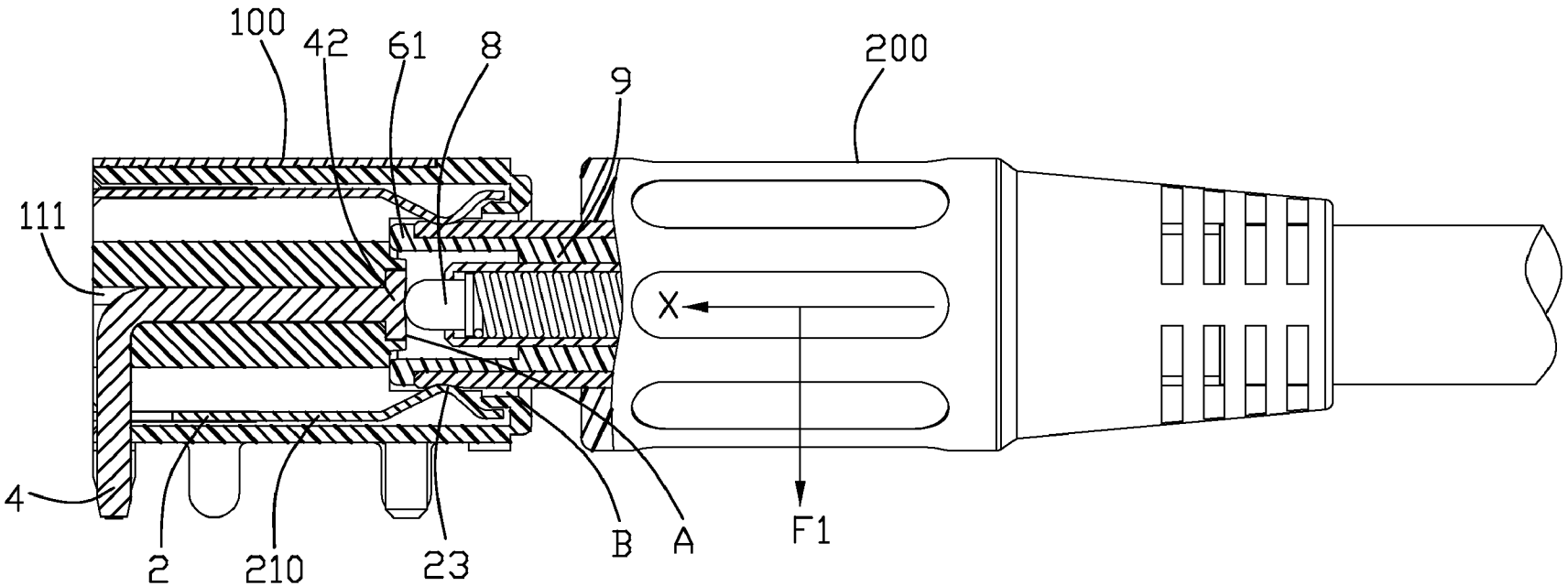
FIGS. 6-8 are cross sectional views taken along line 6-6 of FIG. 3, and the FIG. 6 shows the first and second connectors mated in a normal state, the FIG. 7 shows the second connector moved to lie in a Y direction oblique and angled to a X direction under a force F1, and the FIG. 8 shows the second connector disconnected with the first connector under a force F2 along the Y direction.

Referring to FIG. 4 to FIG. 6, the housing 1 of a rectangular configuration defines a front/mating face 10, a rear wall 11 opposite to the mating face 10, a top wall 12 perpendicular to the mating face 10, a bottom/mounting face opposite to the top face and a pair of sidewalls 13 perpendicular to the mating face 10 and the mounting face. A columnar mating cavity 101 runs through the mating face 10 and a supporting face A is provided therein, the mating cavity 101 is provided between the mating face 10 and the supporting face A. A receiving hole 111 is defined into the rear wall 11 at a middle portion thereof and runs through the supporting face A to communicate with the mating cavity 101. Two contact passageways 112, 113 are defined into the rear wall 11 and each includes an L-shaped retaining portion adjacent to the rear wall and a receiving portion 114 extending forwards to communicate with the mating cavity 101 at a front portion thereof.

The first contact 2 includes two similar L-shaped elastic contacts 20 bending from metal pieces. Each elastic contact 20 defines an L-shaped retaining portion having a horizontal first retaining portion 21 and a second retaining portion 22 vertical to the first retaining portion 21, two elastic arms respectively extending forwards from the first and second retaining portions 21, 22 each defining a linear mainly portion 210 and an arc-shaped contacting arm 23 provided at a free end of the mainly portion 210. The length of the linear mainly portion 210 along a mating direction (X direction) is longer than that of the contacting arm 23. Those two elastic contacts 20 are respectively assembled into the passageways 112, 113 from the rear wall 11 and retained thereto with the retaining portions 21, 22 engaging with the retaining portions and the projections 26 locking with the through holes 132 disposed at the sidewalls 13 thereof. The mainly portions 210 each is received in the corresponding receiving portion 114, and the contacting portions 231 of the contacting arms 23 project into the mating cavity 101 and are defined as a circular. The linear mainly portion 210 is disposed behind supporting face A along the mating direction (X direction), and the contacting arm 23 is disposed before the supporting face A and closer to the mating face 10 than that of the supporting face A along the mating direction. The soldering portion 25 of each elastic contact 20 extends out of the housing 1. In other embodiments, the separated elastic contacts 20 can be integrally manufactured as one single member to provide a circular elastic contact.

The central contact 4 defines a retaining portion 41 and a enlarged contacting portion 42 extending forwards from the retaining portion 41. The central contact 4 is inserted into the receiving hole 111 from the mating face 10 thereof, and the contacting portion 42 is exposed onto the supporting face A, and the retaining portion 41 is retained to the receiving hole 111. The rear portion of the retaining portion 41 is bent to the mating face and defined as a soldering portion 43. The contacting portion 42 of the central contact 4 is surrounded by the arc-shaped contacting arms 23. The central contact 4 acts as a power contact, while the first contact 2 acts as a grounding contact for the first connector 100. The shell 5 is assembled and retained to the housing 1 by the locking portions 51, 52 locking with the corresponding protrusions 121, 131.

Figure 2:
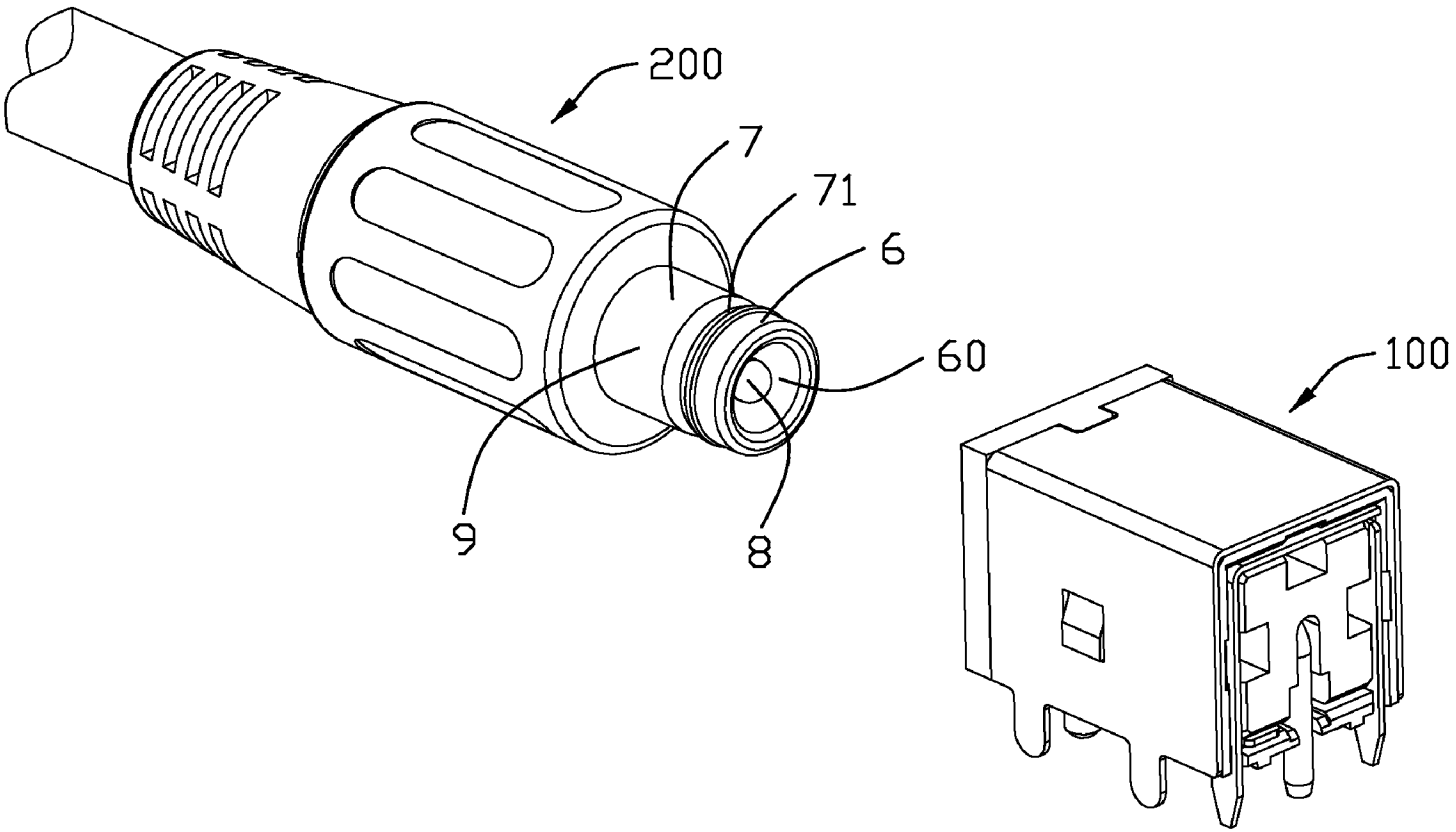
FIG. 2 is another perspective view of the electrical connector assembly shown in FIG. 1.
Figure 3:
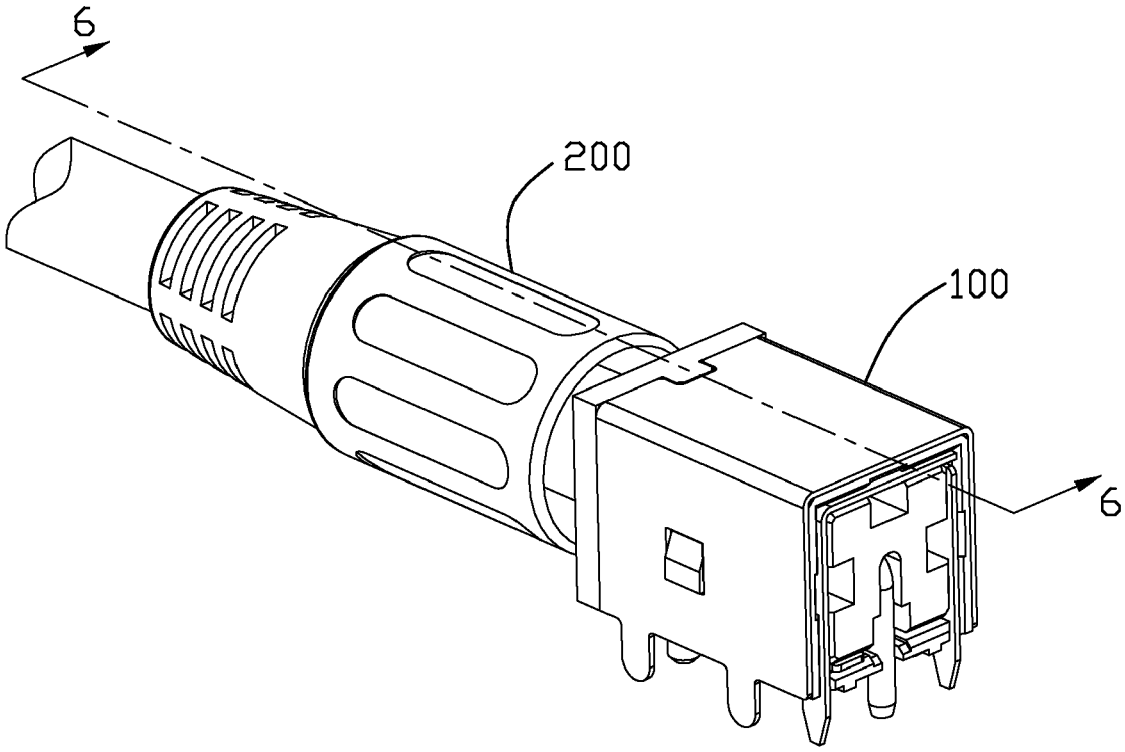
FIG. 3 is a perspective view of the first and second connectors of the electrical connector assembly shown in FIG. 1 and are mated together.

Referring to FIG. 1, FIG. 2 and FIG. 6, the second connector 200 defines a insertion portion 9 for inserting into the mating cavity, which includes a columnar insulative housing 6 defining a receiving hole 60 at a middle portion thereof, a first metal shell 7 surrounding the outer surface of the housing 6 and an elastic contacting contact 8 disposed at a middle portion of the receiving hole 60. The metal shell 7 defines a slot 71 around the front end thereof, and the elastic contacting contact 8 is provided as a pogo contact which includes a spring therein for providing elasticity. The diameter D of the mating cavity is larger than that (d) of the insertion portion 9, and a receiving room B is provided surrounding the insertion portion 9 when the insertion portion 9 is inserted into the mating cavity 101.

Figure 7:
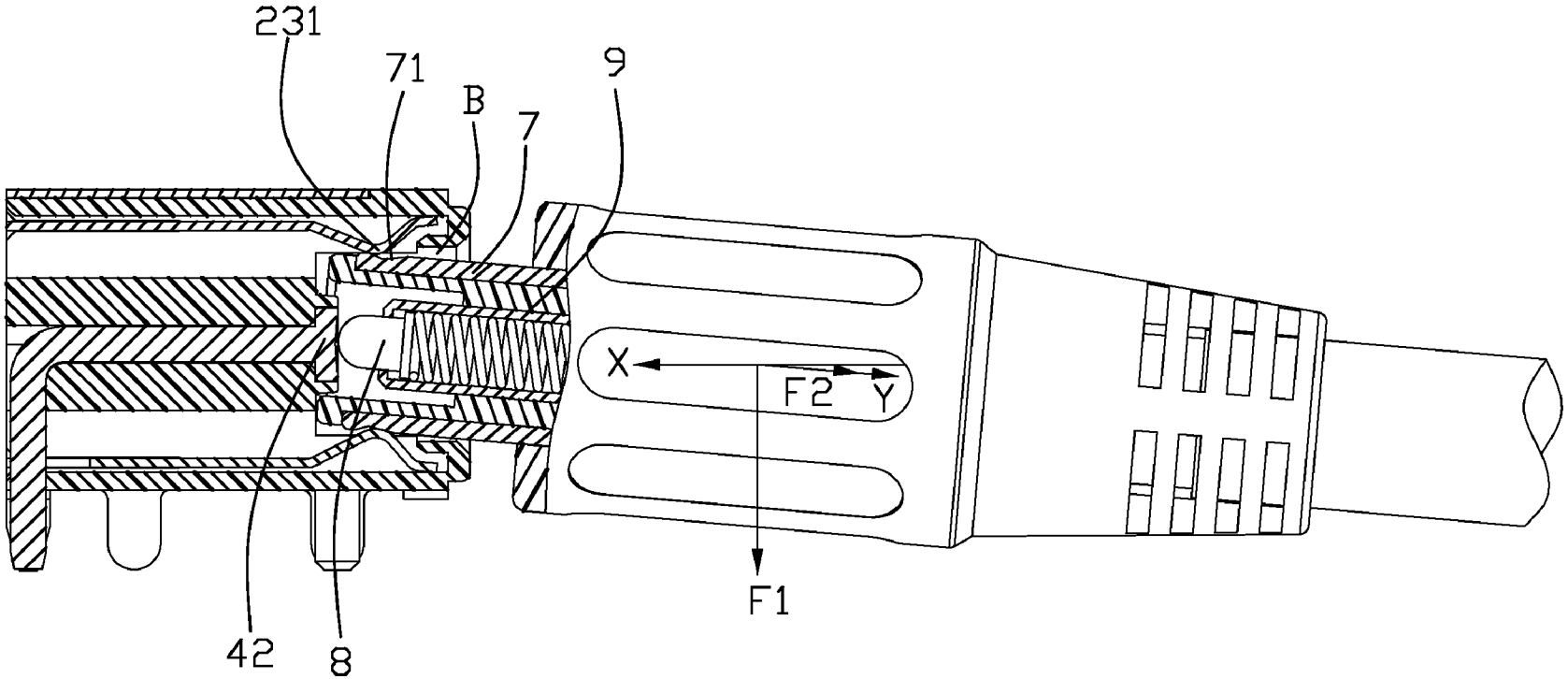
Figure 8:
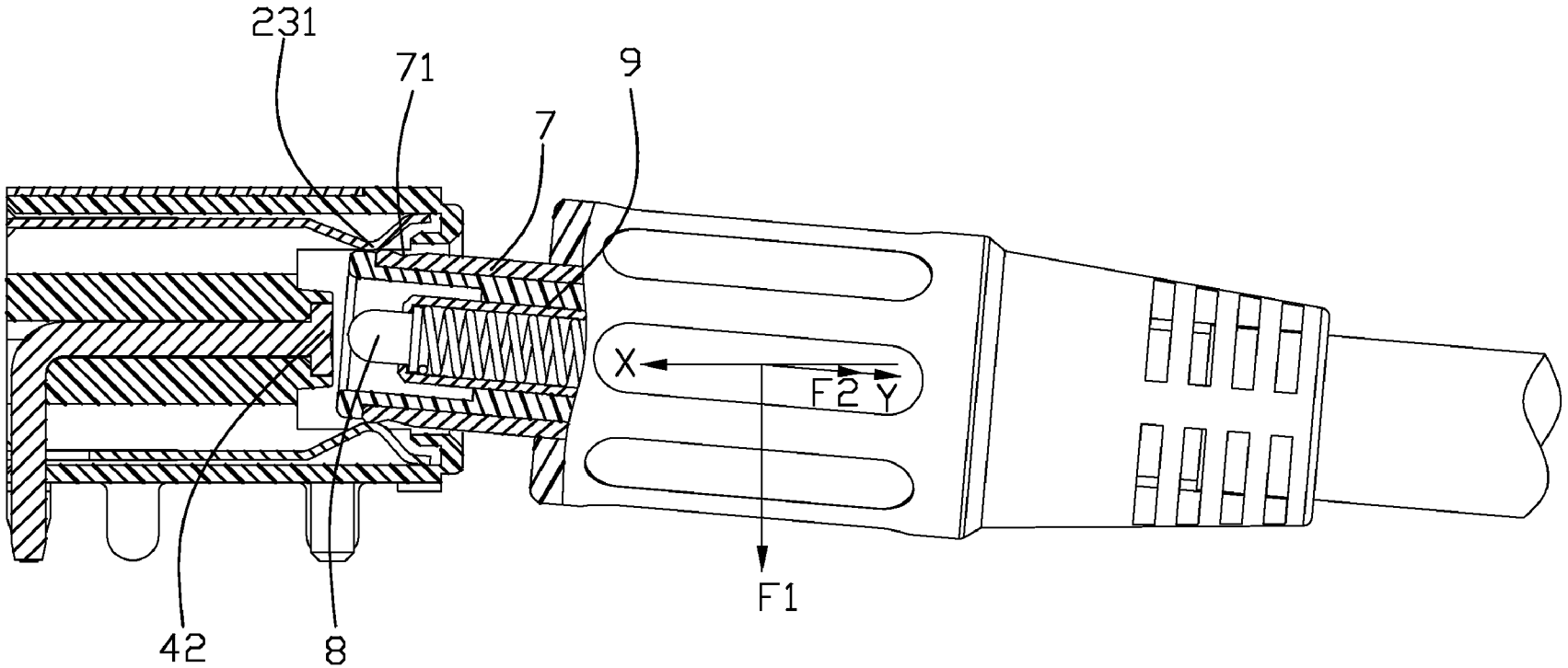
Figure 9:
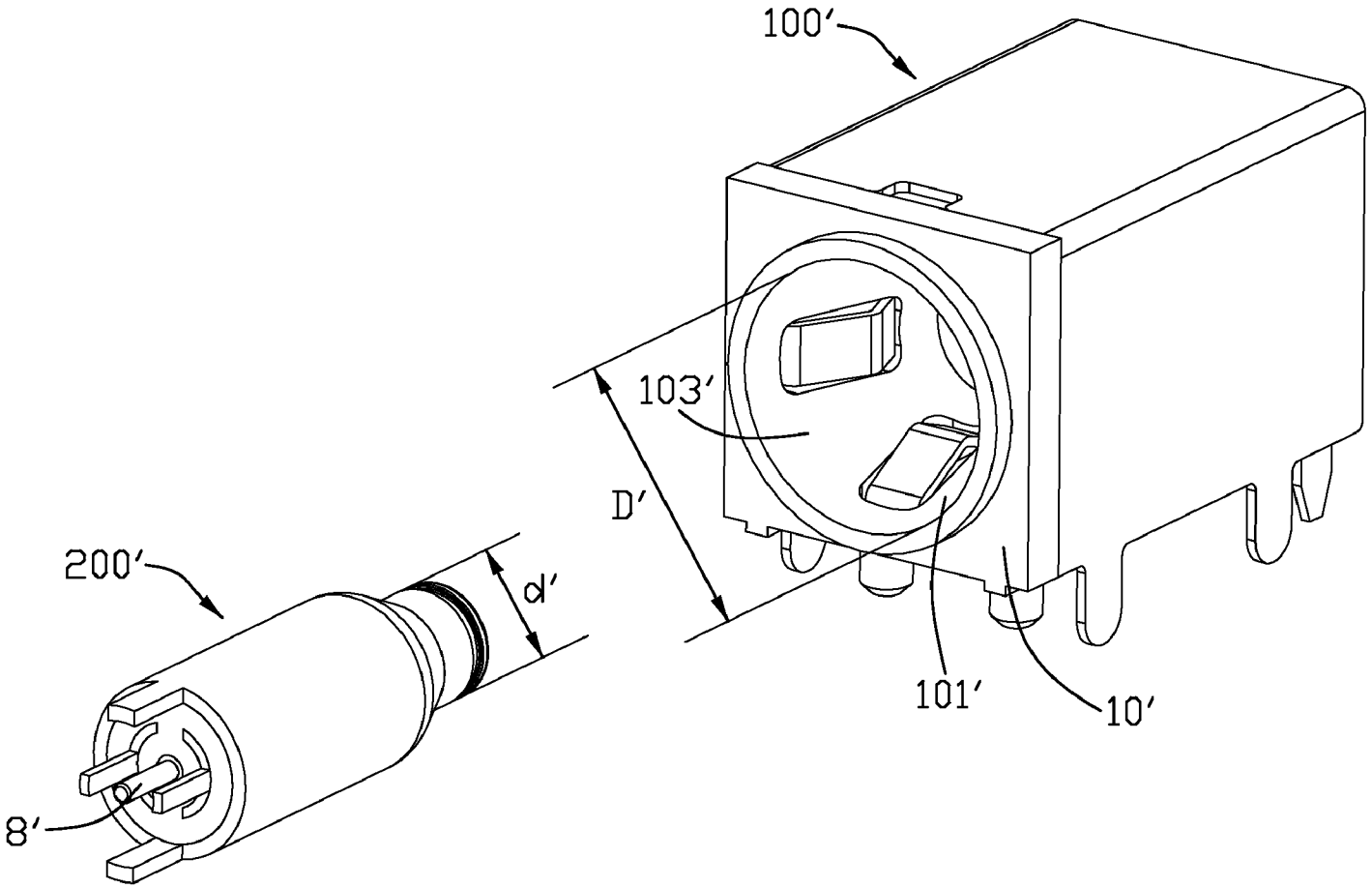
FIG. 9 is a perspective view of the electrical connector assembly in accordance with a second embodiment of the present invention.
Figure 10:
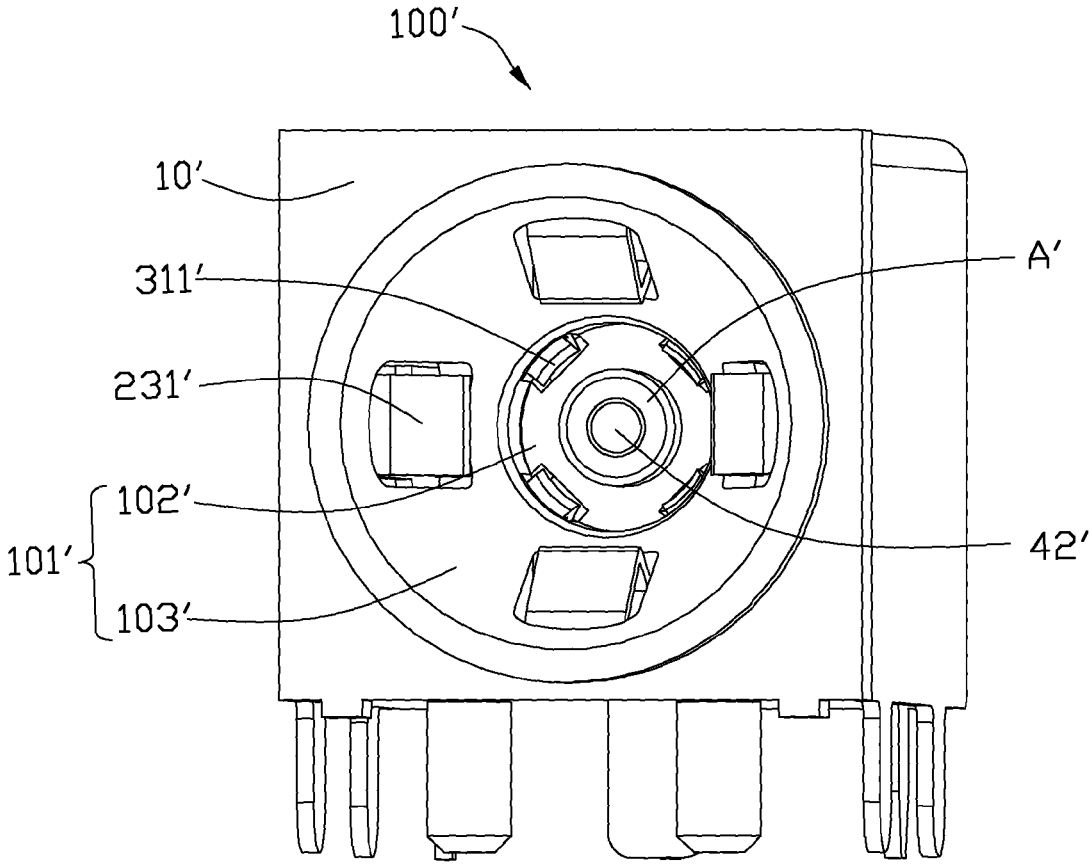
FIG. 10 is a perspective view of the first connector shown in FIG. 9.
Figure 11:
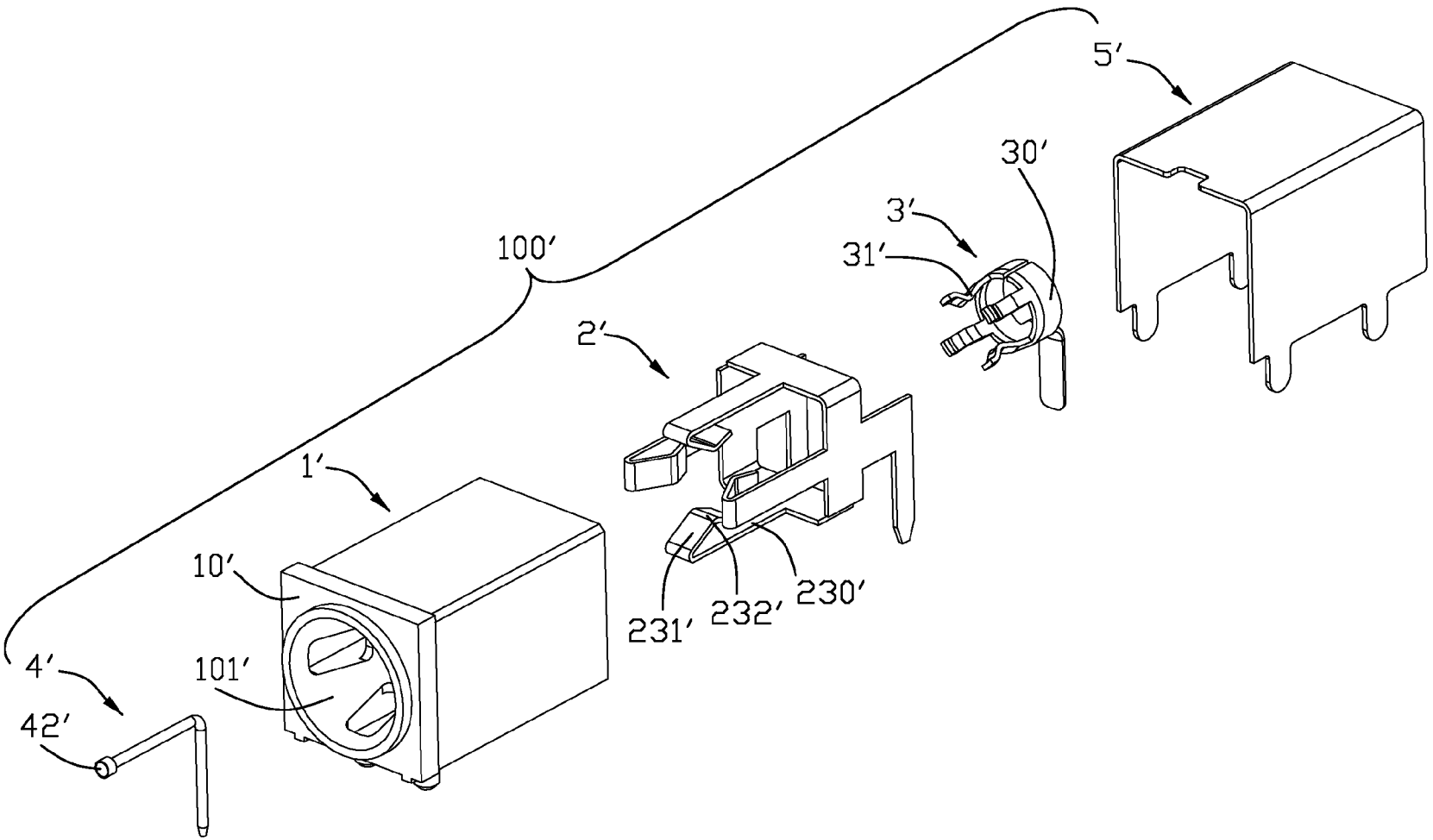
FIG. 11 is an exploded perspective view of the first connector shown in FIG. 10.
Figure 12:
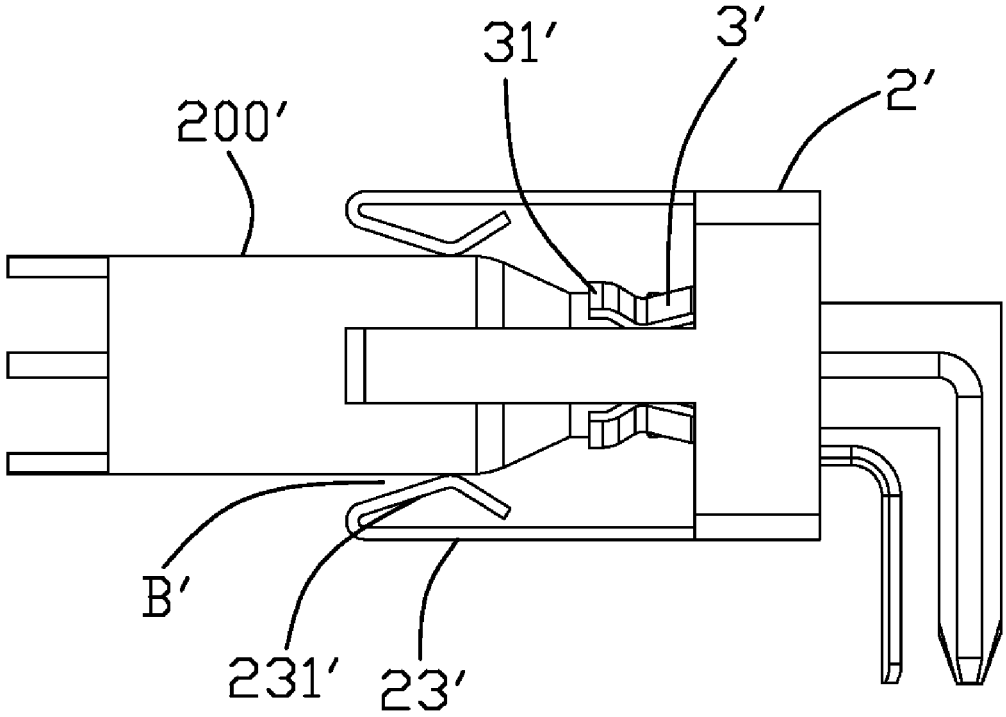
FIG. 12 is a perspective view of a plurality of contacts shown in FIG. 10 connected with a second connector shown in FIG. 9.
Figure 13:
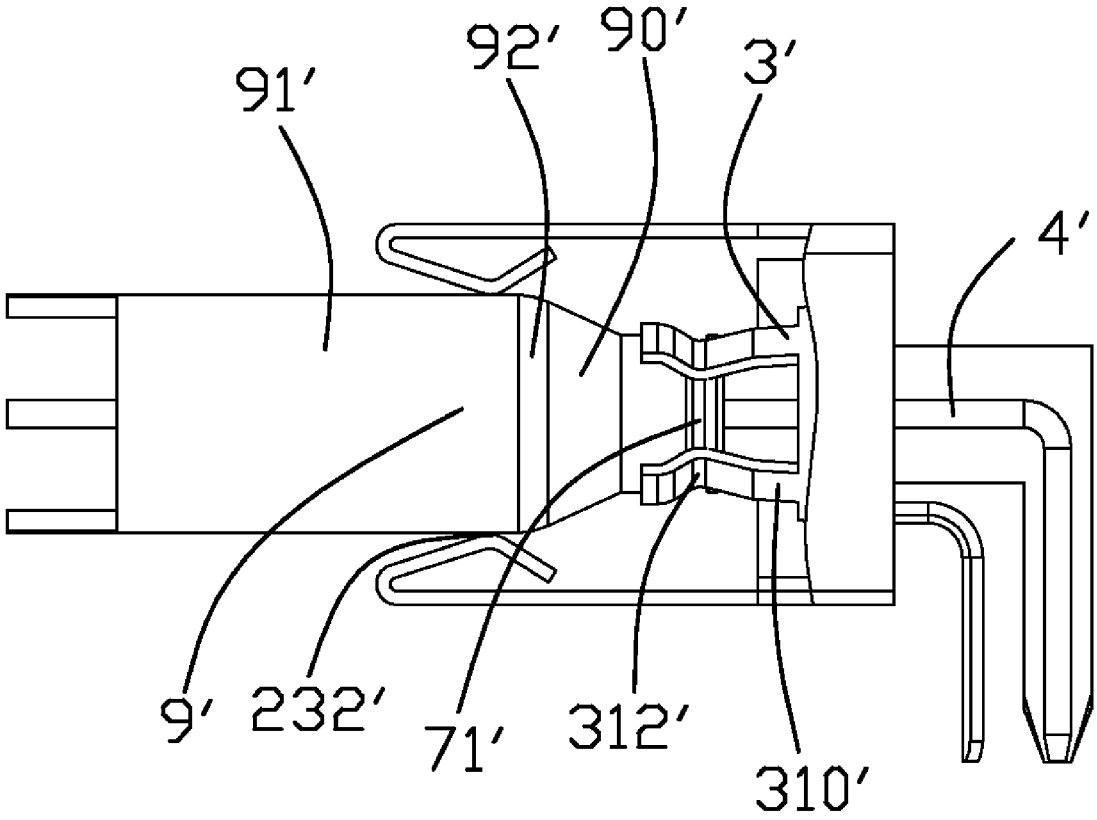
FIG. 13 is a perspective view of the plurality of contacts connected with the second connector shown in FIG. 12 with a contacting arm of a second contact removed.
Figure 14:
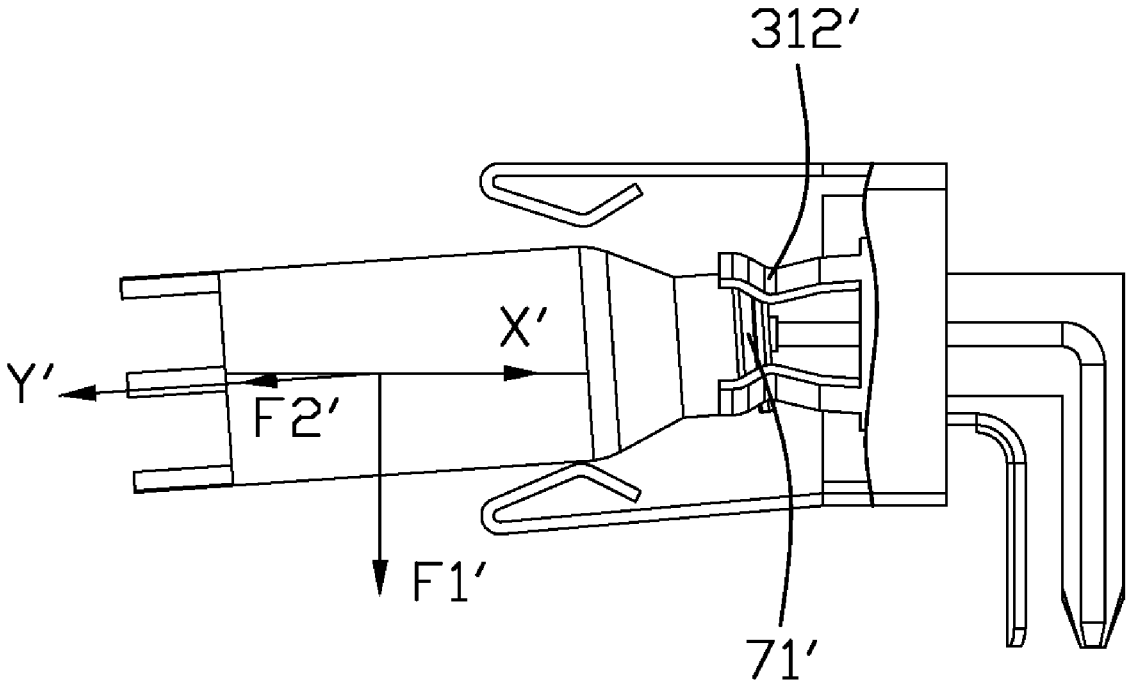
FIG. 14 is a perspective view of the second connector moved to lie in a Y' direction oblique and angled to a X' direction under a force F1' shown in FIG. 13.
Figure 15:
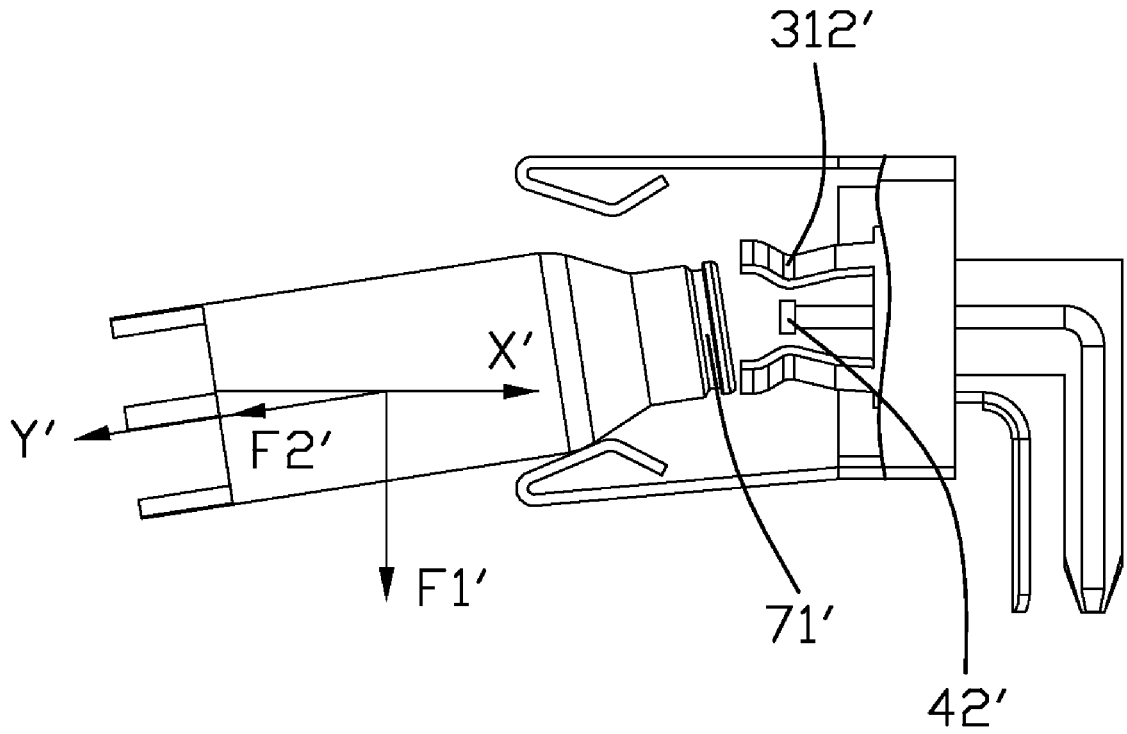
FIG. 15 is a perspective view of the second connector disconnected with the first connector under a force F2 along the Y direction shown in FIG. 14.

Referring to FIG. 6 to FIG. 8, while the first connector 100 mates with the second connector 200, the insertion portion 9 comes into the mating cavity 101 from the mating direction (X direction), the contacting contact 8 elastically abuts against the contacting portion 42 exposed onto the supporting face A and the contacting arms 23 surrounding the contacting portion 42 contacting the metal shell 7 and clipping into the slot 71 to retain the insertion portion 9 in the mating cavity 101 steadily. The second connector 200 can be disconnected and dropped from the mating cavity 101' normally by being pulled outwards along a direction parallel to a mating direction (X'). Moreover, when a cable connected to the second connector 200 is tripped inadvertently, a force F1 which is along a direction oblique to the mating direction (X direction) will be created, in this embodiment, the force F1 is defined as along a downward direction normal to the mating direction, the rear portion of the insertion portion 9 will move downwardly in the receiving room B until it lies in a direction oblique and angled to the mating direction (X direction). When the insertion portion 9 moves to lie in line with the cable in a Y direction which is oblique and angled to the mating direction (X direction), a component of force F2 of the F1 created along the cable in the Y direction will pull the insertion portion 9 moving outwards along with the cable, simultaneously, the contacting contact 8 disconnects with the contacting portion 42 and contacting portions 231 move out of the slot 71, and finally the insertion portion 9 drops from the mating cavity 101 along the Y direction. The second connector 200 can be pulled out from the mating cavity 101 along a direction oblique and angled to the mating direction, which can make the first and second connectors 100, 200 disconnected rapidly under an abnormal force.

FIG. 9 to FIG. 13 shows a second embodiment of the invention about a new type connector assembly. The first connector 100' includes a housing 1' defining a mating face 10', a plurality of contacts retained to the housing and a shell 5' surrounding the housing 1'. A mating cavity 101' is defined into the mating face 10' and includes a columnar first receiving cavity 102' adjacent to the rear face and a second receiving cavity 103' disposed in front of the first receiving cavity 102' and extending gradually enlarging toward the mating face 10' and providing an opening at the mating face 10' thereof. A supporting face A' is disposed in the first receiving cavity 102' and the mating cavity 101' is disposed between the mating face 10' and the supporting face A'.

The plurality of contacts includes a first contact 3', a second contact 2' and a central contact 4'. The first contact 3' defines a circular retaining portion 30' and four elastic arms 31' extending forwards from the retaining portion 30'. Each elastic arm 31' also defines a mainly portion 310' and an arc-shaped contacting arm 311' disposed at a distal end of the mainly portion 310'. The first contact 3' is retained to the housing 1' from the rear face thereof, and the contacting arms 311' project into the first receiving cavity 102' and form a circle surround the contacting portion 42'. The second contact 2' also includes two similar elastic contacts 20' which have a similar configuration as the first contact 2, but the contacting arm 231' extends rearwards from the distal end of the mainly portion 230'. The second contact 2' also is retained to the housing 1' from the rear face thereof, and the contacting arms 231' project into the second receiving cavity 103'. The first contact 3' acts as a power contact, while the second contact 2' acts as a grounding contact for the second connector 200', and the central contact 4' acts as a detecting pin. The central contact 4' also is retained to the housing with the contacting portion 42' exposed onto the supporting face A' and surrounded by the contacting arms 231'.

The configuration of the insertion portion 9' of the second connector 200' is similar to the insertion portion 9 except that the insertion portion 9' gradually deflates at a front portion thereof to correspond to the second receiving cavity 103' and defines two metal shells 90', 91' surrounding the outside surface thereof. The first shell 90' surrounds the front portion of the insertion portion 9' and the second shell 91' covers the rear portion thereof, and the two shells 90', 91' are separated and insulated by an insulative portion 92'. When the insertion portion 9' is mated with the first connector 100', the distal end covered by the first shell 90' is received in the first receiving cavity 102' with the slot 71' contacted and clipped by the contacting portions 312', and the rear portion covered by the second shell 91' is received in the second receiving cavity 103' and contacted and clipped by the contacting portion 232'. The contacting portion 42' exposed onto the supporting face is abutted against by an elastic contact 8' which is disposed at a middle portion of insertion portion 9' at a front face thereof. The diameter D' of the opening of the second mating cavity 103' is larger than that (d) of the insertion portion 9', and a receiving room B' is provided surrounding the insertion portion 9'. Similar to the first embodiment, the second connector 200' also can be disconnected and dropped from the mating cavity 101' normally by being pulled outwards along a direction parallel to a mating direction (X' direction). Moreover, when a cable connected to the second connector 200' is pulled inadvertently, a force F1' also will be created, and the rear portion of the insertion portion 9' will move in the receiving room B' until it lies in a direction oblique and angled to the mating direction (X' direction). When the insertion portion 9' moves to lie in line with the cable in a Y' direction which is oblique and angled to the X' direction, a component of force F2 of the F1 created along the cable in the Y' direction will pull the insertion portion 9' moving outwards along the Y' direction, simultaneously, the contacting portions 312' move out of the slot 71, and the second connector 200' can be pulled out from the mating cavity 101' along the Y' direction, which can make the first and second connectors 100', 200' disconnected rapidly under an abnormal force.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing defining a mating face, a supporting face facing to the mating face and a mating cavity recessed from the mating face towards the supporting face and disposed therebetween; and a plurality of contacts retained in the housing, including a central contact and a first contact, the central contact defining a contacting portion exposed onto the supporting face and a soldering portion extending out of the housing, the contacting portion having a contacting face disposed in the mating cavity for head-to-head abutting against a counterpart contact of a mating connector that enables the mating connector to readily become obliquely to a mating direction, the first contact including at least two arc-shaped contacting arms projecting into the mating cavity and disposed beside the contacting portion of the central contact, each contacting arm being deformable along the mating direction and a radial direction perpendicular to the mating direction when mating with a counterpart contact, but a free end of the contacting arm restricted by stopping means of the insulative housing and limited excessively deformation so as to providing enough retaining force for the mating connector.

2. The electrical connector as described in claim 1, wherein the at least two arc-shaped contacting arms are opposite to each other and disposed at two sides of the contacting portion of the central contact.

3. The electrical connector as described in claim 2, wherein the first contact defines a retaining portion and at least two linear mainly portions extending forwards from the retaining portion, and the at least two arc-shaped contacting arms is disposed at a corresponding front end of the at least two linear mainly portions.

4. The electrical connector as described in claim 3, wherein the mainly portion is disposed behind the supporting face along the mating direction.

5. The electrical connector as described in claim 4, wherein the arc-shaped contacting arms each defines a contacting portion projecting into the mating cavity and disposed closer to the mating face than the contacting portion of the central contact in the mating direction.

6. The electrical connector as described in claim 1, wherein the mating cavity includes a first receiving cavity adjacent to the supporting face and a second receiving cavity communicating with the first receiving cavity and extending gradually enlarging toward the mating face.

7. The electrical connector as described in claim 6, wherein the contacting arms of the first contact project into the first receiving cavity and form a circle surround the contacting portion of the central contact.

8. The electrical connector as described in claim 7, further defining a second contact disposed outside the first contact and the central contact, and the second contact defines contacting arms projecting into the second receiving cavity and form a second circle thereof.

9. The electrical connector as described in claim 1, wherein the insulative housing defines receiving portions recessed from an inner wall of the mating cavity and extending forwardly to communicate with the mating cavity, and the stopping means is disposed in front of each receiving portion.

10. The electrical connector as described in claim 9, wherein the stopping means defines three walls connected to surround the free end.

11. The electrical connector as described in claim 9, wherein the contacting arm is received in the receiving portion with a contacting portion projecting into the mating cavity, and the contacting portion enters into the receiving portion when the contacting arm is deflected by the oblique mating connector.

12. An electrical connector assembly comprising:

a first connector comprising:

an insulative housing defining a mating face, a supporting face facing to the mating face and a mating cavity opening through the mating face and disposed between the supporting face and the mating face;

a plurality of contacts retained in the housing, including a central contact with a part having a contacting face exposed onto the supporting face and disposed in the mating cavity and a first contact defining at least two clip portions projecting into the mating cavity and a soldering portion extending away from the housing; and a second connector mating with the first connector in a mating direction, comprising an inserting portion inserted into the mating cavity, and the insertion portion defining a first metal shell surrounding the outer surface at a front portion thereof and a contacting contact received in a receiving hole for mating with the central contact, the receiving hole recessed from a front face of the insertion portion at a middle portion thereof, and the contacting contact received in the receiving hole without any portion extending beyond the front face;

wherein the at least two clip portions clip and connect with the first metal shell, and the contacting face head-to-head abuts against the contacting contact that enables the second connector to readily become obliquely to the mating direction.

13. The electrical connector assembly as described in claim 12, wherein the mating cavity further provides a receiving room surrounding the insertion portion, and the insertion portion moves in the receiving room to be oblique and angle to the mating direction.

14. The electrical connector assembly as described in claim 12, wherein the contacting contact of the second connector elastically abuts against the contacting portion of the central contact, and the elasticity of the contacting contact of the second connector is provided by a spring.

15. The electrical connector assembly as described in claim 14, wherein the first connector further includes a second contact disposed outside the first contact and defining contacting arms projecting into the mating cavity to form a circle thereof, and the insertion portion further defines a second shell insulated from the first shell to correspond to the contacting arms of the second contact.

16. The electrical connector assembly as described in claim 12, wherein the insulative housing defines receiving portions recessed from an inner wall of the mating cavity and extending forwardly to communicate with the mating cavity, and the clip portion enters into the receiving portion when the second connector is oblique.

17. The electrical connector assembly as described in claim 12, wherein the housing defines a step structure around an opening of the mating cavity for facilitating titling of the second connector while the first metal shell defines an annual slot in an outer surface into which the two clip portions are received.

18. A connector assembly, comprising:

a receptacle connector defining a mating cavity and including a first contact disposed centrally in the mating cavity, and a second contact having resilient contacting arms arranged circumferentially across an inner wall of the mating cavity, the receptacle connector providing receiving portions respectively recessed from the inner wall of the mating cavity, and each contacting arm received in the receiving portion with a contacting portion projecting into the mating cavity;

a plug connector mated to the receptacle connector by an insertion portion insertion into the mating cavity, and including a third contact received in a receiving hole for head-to-head interconnecting with the first contact, and a fourth contact mating with the second contact, the receiving hole recessed from a front face of the insertion portion at a middle portion thereof, and the third contact received in the receiving hole without any portion extending beyond the front face;

wherein the first contact head-to-head abuts against the third contact to permit the plug connector tilted and disengaged from the receptacle connector, and the contacting portion of the second contact enters into the receiving portion when the contacting arm is deflected by the tilted plug connector.

19. The connector assembly as claimed 18, wherein the receptacle connector is further equipped with a fifth contact arranged in a circumferential manner, and radially located between the first contact and the second contact.

20. The connector assembly as claimed in claim 19, wherein said second contact applies forces upon the fourth contact radially in the circumferential manner, and the third contact applies a force upon the first contact axially, while the fifth contact applies forces upon the fourth contact not only axially but also radially in the circumferential manner.

* * * * *